US006868569B2

(12) United States Patent
VanSteenburg

(10) Patent No.: US 6,868,569 B2
(45) Date of Patent: Mar. 22, 2005

(54) REVERSED AIR MATTRESS

(75) Inventor: Kip VanSteenburg, Sudbury, MA (US)

(73) Assignee: The OR Group, Inc., Batesville, IN (US)

( * ) Notice: Subject to any disclaimer, the term of this patent is extended or adjusted under 35 U.S.C. 154(b) by 0 days.

(21) Appl. No.: 10/348,474

(22) Filed: Jan. 21, 2003

(65) Prior Publication Data

US 2004/0003471 A1 Jan. 8, 2004

Related U.S. Application Data

(60) Provisional application No. 60/353,393, filed on Feb. 1, 2002.

(51) Int. Cl.[7] ..... A47C 27/18; A61G 7/057

(52) U.S. Cl. ..... 5/709; 5/910; 5/713; 5/727; 5/740

(58) Field of Search ..... 5/709, 740, 9, 5/10, 727, 713

(56) References Cited

U.S. PATENT DOCUMENTS

| | | | | | |
|---|---|---|---|---|---|
| 2,779,034 | A | | 1/1957 | Arpin | |
| 3,730,588 | A | | 5/1973 | Braun | |
| 4,371,997 | A | | 2/1983 | Mattson | |
| 4,436,125 | A | | 3/1984 | Blenkush | |
| 4,679,582 | A | | 7/1987 | Zwicker | |
| 4,919,483 | A | | 4/1990 | Horkey | |
| 4,951,335 | A | * | 8/1990 | Eady | 5/709 |
| 4,982,465 | A | | 1/1991 | Nagata et al. | |
| 4,995,124 | A | | 2/1991 | Wridge, Jr. et al. | |
| 5,033,133 | A | | 7/1991 | Nissen | |
| 5,033,777 | A | | 7/1991 | Blenkush | |
| 5,103,517 | A | | 4/1992 | Krouskop | |
| 5,107,887 | A | | 4/1992 | White et al. | |
| 5,159,726 | A | * | 11/1992 | Bloch et al. | 297/284.2 |
| 5,176,424 | A | | 1/1993 | Tobita et al. | |
| 5,259,080 | A | | 11/1993 | Blaha | |
| 5,487,196 | A | | 1/1996 | Wilkinson et al. | |
| 5,647,079 | A | | 7/1997 | Hakamiun et al. | |
| 5,711,340 | A | | 1/1998 | Gusky et al. | |
| 5,760,301 | A | | 6/1998 | Shuman, Jr. | |
| 5,845,943 | A | | 12/1998 | Ramacier, Jr. et al. | |
| 5,899,223 | A | | 5/1999 | Shuman, Jr. | |
| 5,960,496 | A | * | 10/1999 | Boyd | 5/722 |
| 6,003,555 | A | | 12/1999 | Sheng | |
| 6,012,188 | A | | 1/2000 | Daniels et al. | |
| 6,056,008 | A | | 5/2000 | Adams et al. | |
| 6,089,259 | A | | 7/2000 | Shuman, Jr. | |
| 6,092,249 | A | * | 7/2000 | Kamen et al. | 5/653 |
| 6,178,997 | B1 | | 1/2001 | Adams et al. | |
| 6,212,718 | B1 | | 4/2001 | Stolpmann et al. | |
| 6,212,720 | B1 | * | 4/2001 | Antinori et al. | 5/727 |
| 6,243,894 | B1 | * | 6/2001 | Kosumsuppamala et al. | 5/425 |
| 6,318,407 | B1 | | 11/2001 | Kohn et al. | |
| 6,671,911 | B1 | * | 1/2004 | Hill et al. | 5/713 |
| 2002/0148045 | A1 | * | 10/2002 | Giori et al. | 5/709 |

FOREIGN PATENT DOCUMENTS

| | | |
|---|---|---|
| EP | 1166740 | 1/2002 |
| JP | 10014992 | 1/1998 |

OTHER PUBLICATIONS

Allen® Medical Systems '99 Product Brochure, 20 pages, © 1998.

O.R. Direct Fall 1999 Product Brochure, 24 pages, © 1999.

* cited by examiner

*Primary Examiner*—Michael Trettel
(74) *Attorney, Agent, or Firm*—Barnes & Thornburg

(57) ABSTRACT

A person-support apparatus for use with a suction source comprises a core having a one or more foam elements and a cover having an interior region in which the core is situated. The cover is in fluid communication with the suction source and the suction source operates to evacuate a portion of air from the interior region so that at least one of the foam elements is partially compressed within the interior region of the cover due to the evacuation of the portion of air.

72 Claims, 7 Drawing Sheets

REVERSED AIR MATTRESS

This application claims the benefit, under 35 U.S.C. § 119(e), of U.S. Provisional Patent Application Ser. No. 60/353,393 which was filed Feb. 1, 2002 and which is hereby expressly incorporated by reference herein.

BACKGROUND

The present disclosure relates to mattresses, support pads, cushions, and the like. More particularly, the present disclosure relates to mattresses, support pads, etc. having a foam piece situated within a cover to which suction is applied to reduce the volume of the foam piece.

Mattresses, support pads, cushions, and the like that have one or more foam pieces surrounded by a covering or casing to which suction or vacuum is applied to reduce the volume of the one or more foam pieces are known. See, for example, U.S. Pat. Nos. 6,092,249; 5,159,726; and 3,730,588.

It is known that high interface pressures between a person and a pad, mattress, etc. supporting the person can lead to unwanted complications such as decubitus ulcers or pressure sores. Thus, it is desirable to minimize interface pressures between a person and the underlying support structure. It is known that mattresses and pads made of softer foam having low indentation load deflection (ILD) values, in general, produce lower interface pressures than mattresses and pads made of harder foam having high ILD values. However, low ILD foam is easily compressible and therefore, a rather large thickness of low ILD foam is needed to prevent "bottoming" of a body supported by the low ILD foam. Bottoming occurs when a foam element, or any type of support element, no longer supports the body, but rather, the body is being supported by whatever structure is beneath the element.

SUMMARY

According to the present disclosure, a mattress, support pad, cushion, or the like (referred to throughout the written description and claims as a "person-support apparatus") comprises a core having a first foam element which, in turn, has a vertical thickness, a horizontal length, and a horizontal width. The vertical thickness is smaller than both the horizontal length and the horizontal width when the first foam element is in an uncompressed state. The person-support apparatus further comprises a cover having an interior region in which the core is situated. The first foam element fills at least a majority of the interior region. The cover has an opening in fluid communication with the suction source. The suction source operates to evacuate a portion of air from the interior region so that the first foam element is partially compressed within the interior region of the cover due to the evacuation of the portion of air.

In illustrative embodiments, suction from the suction source is applied to the interior region of the cover through one or more conduits and a pressure regulator. The pressure regulator is configured to establish a predetermined negative pressure in the interior region. In some embodiments, the suction source is provided by a vacuum pump or compressor. In embodiments configured for use in a hospital or other healthcare facility where suction is available from a suction outlet mounted, for example, to a wall or column in a room of the healthcare facility, one of the conduits is coupled to the outlet.

According to this disclosure, the person-support apparatus may include various additional foam pieces or other types of support elements. For example, in some illustrative embodiments, the core includes a layer of foam that underlies the first foam element. In one illustrative embodiment, a foam frame surrounds the sides and ends of the first foam element. In the illustrative embodiment having the foam frame, suction is applied to the first foam element but not to the foam frame so that an upper surface of the first foam element is drawn down into substantially coplanar relation with an upper surface of the foam frame. In accordance with this disclosure, the cover in which the core is situated may be a one-piece cover or a multi-piece cover.

Additional features will become apparent to those skilled in the art upon consideration of the following detailed description of illustrative embodiments exemplifying the best mode of carrying out the disclosure as presently perceived.

BRIEF DESCRIPTION OF THE DRAWINGS

The detailed description particularly refers to the accompanying figures in which.

DETAILED DESCRIPTION OF THE DRAWINGS

Figure 4:
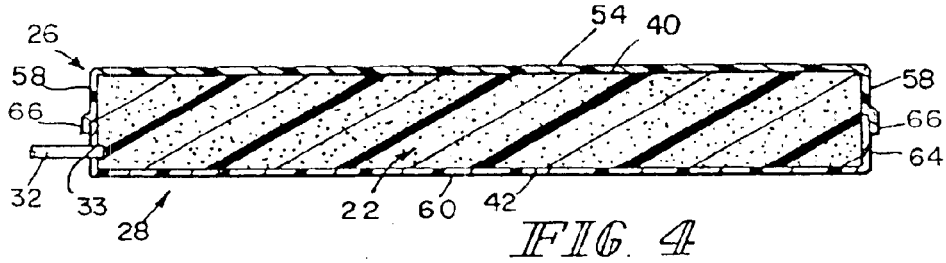
FIG. 4 is a sectional view, similar to FIG. 3, after a preset amount of suction is applied to the interior region, showing the foam block being partially compressed within the interior region of the cover.
Figure 5:
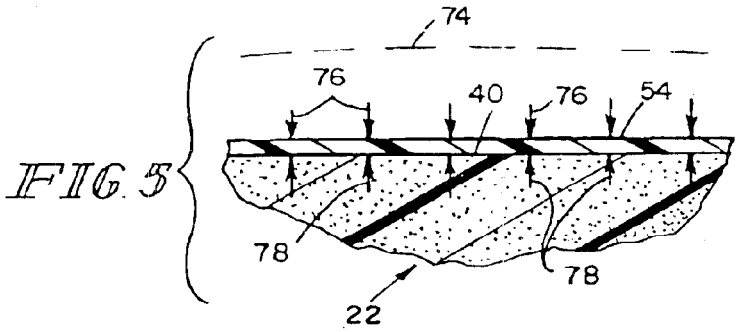
FIG. 5 is an enlarged fragmentary view of a portion of the foam element and upper cover half of FIG. 4 showing the upper surface of the patient-support apparatus being drawn downwardly from an initial position, indicated by a dashed line, by the application of the preset amount of suction and showing a series of arrows indicating a preload condition established at the upper surface of the person-support apparatus due to the application of the preset amount of suction.
Figure 6:
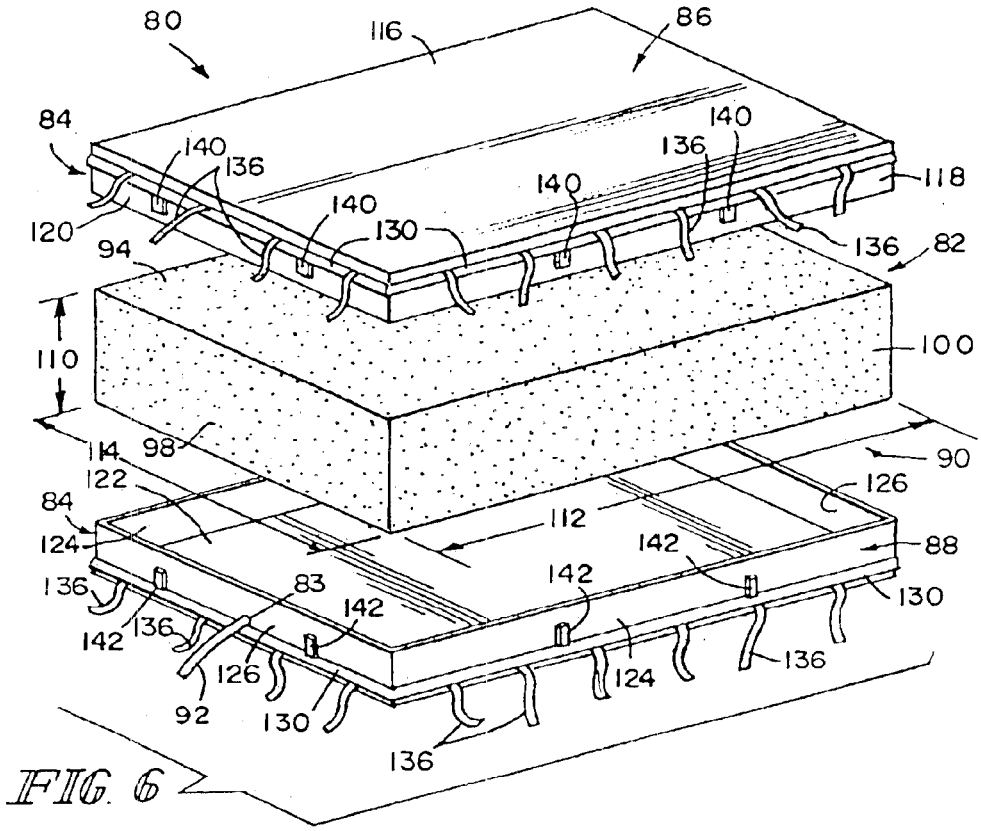
FIG. 6 is an exploded perspective view of an alternative person-support apparatus showing a cover having an upper cover half and a lower cover half, each of the first and second cover halves having a set of stabilizer bars coupled to the sides and ends of the cover halves, a large block of low ILD foam situated between the upper and lower cover halves, and a set of tie straps extending from the sides and ends of each of the cover halves.
Figure 7:
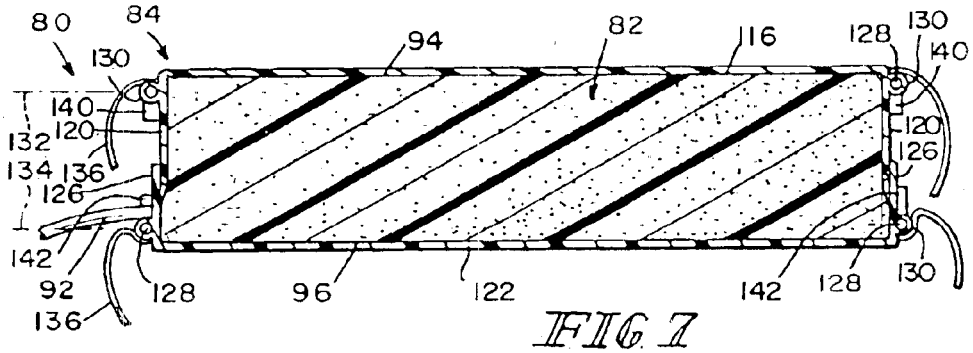
FIG. 7 is sectional view of the person-support apparatus of FIG. 6 showing the stabilizing bars being separated by a first distance prior to application of suction to an interior region of the cover.
Figure 8:
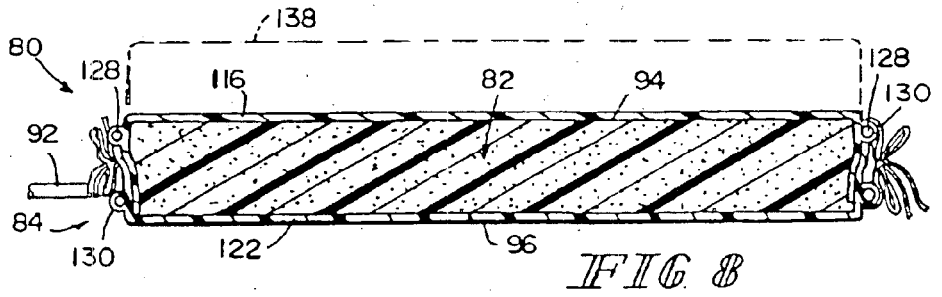
FIG. 8 is a sectional view, similar to FIG. 7, showing the stabilizing bars being drawn together and separated by a second distance smaller than the first distance when suction is applied to the interior region of the cover and showing excess cover material bunched together and retained alongside the foam block by the tie straps which are tied together.
Figure 9:
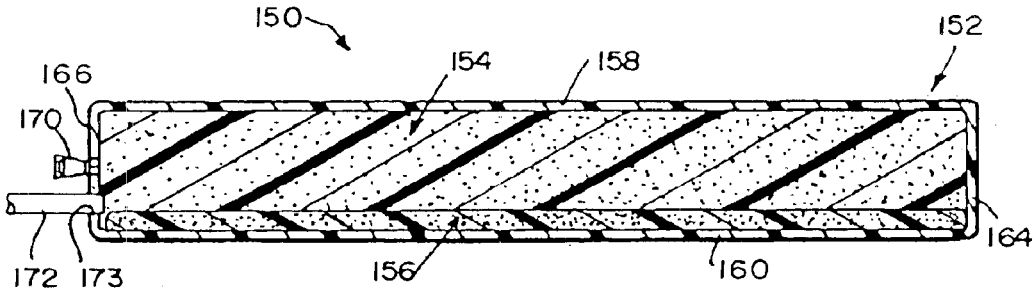
FIG. 9 is a sectional view, similar to FIG. 4, of a second alternative person-support apparatus showing an additional layer of foam underlying a large foam block of low ILD foam, the additional layer of foam and the foam block being situated in an interior region of a one-piece cover, and a preset amount of suction being applied to the interior region.
Figure 10:
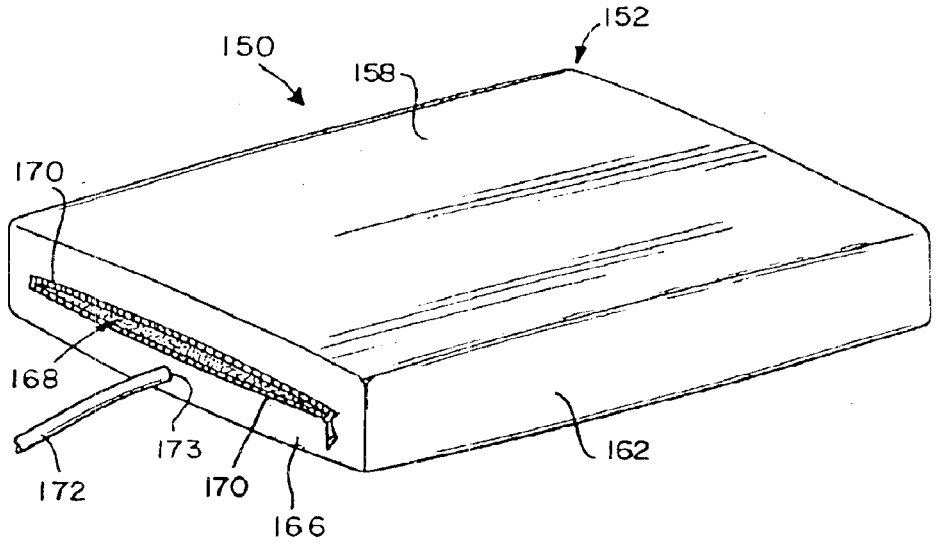
FIG. 10 is a perspective view of the person-support apparatus of FIG. 9 showing an opening at an end of the one-piece cover through which the foam block is inserted into an interior region of the one-piece cover and showing a zipper coupled to the one-piece cover around the opening for opening and closing the one-piece cover.
Figure 11:
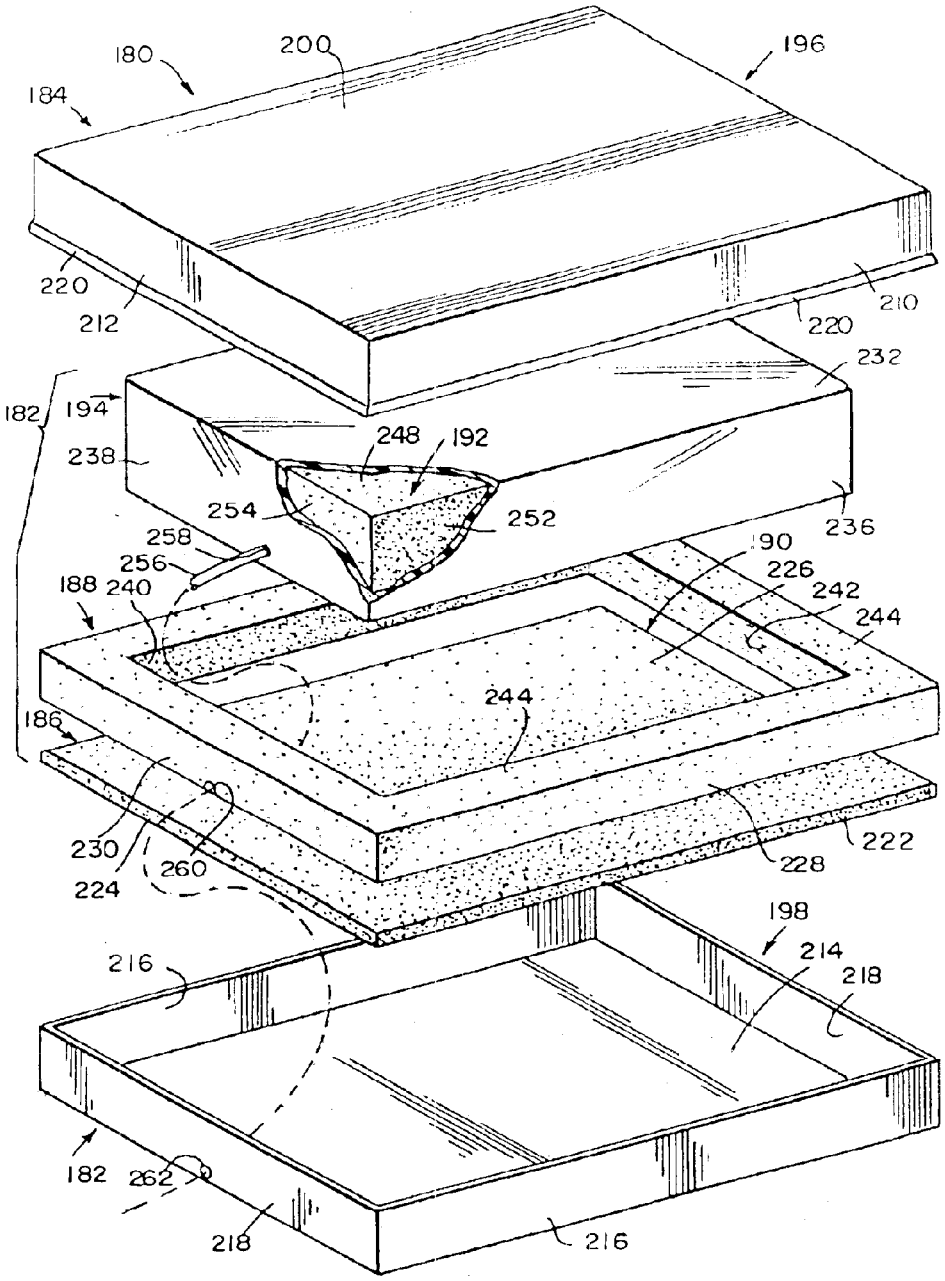
FIG. 11 is an exploded perspective view of a third alternative person-support apparatus showing a cover encasing a large block of low ILD foam, a conduit extending from the cover, a foam frame having a central opening in which the encased foam block is received, a foam layer underlying both the foam frame and the encased foam block, and an outer casing that encapsulates the encased foam block, the foam layer, and the foam frame.
Figure 12:
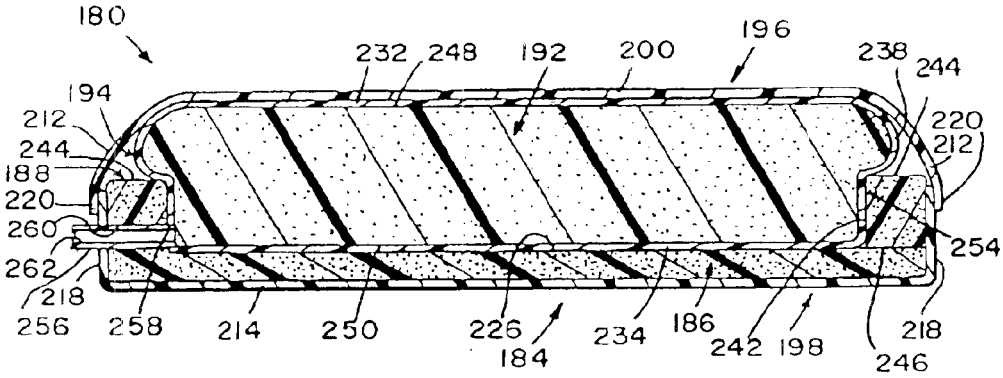
FIG. 12 is a sectional view of the person-support apparatus of FIG. 11 prior to application of a preset amount of suction to an interior region of the cover, showing an upper surface of the encased foam block being higher in elevation than an upper surface of the foam frame.
Figure 13:
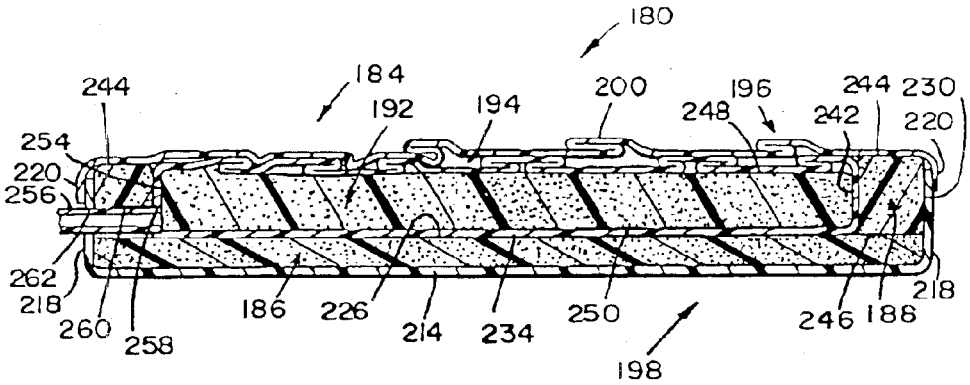
FIG. 13 is a sectional view, similar to FIG. 12, after application of the preset amount of suction to the interior region of the cover, showing the upper surface of the encased foam block being substantially coplanar with the upper surface of the foam frame.
Figure 14:
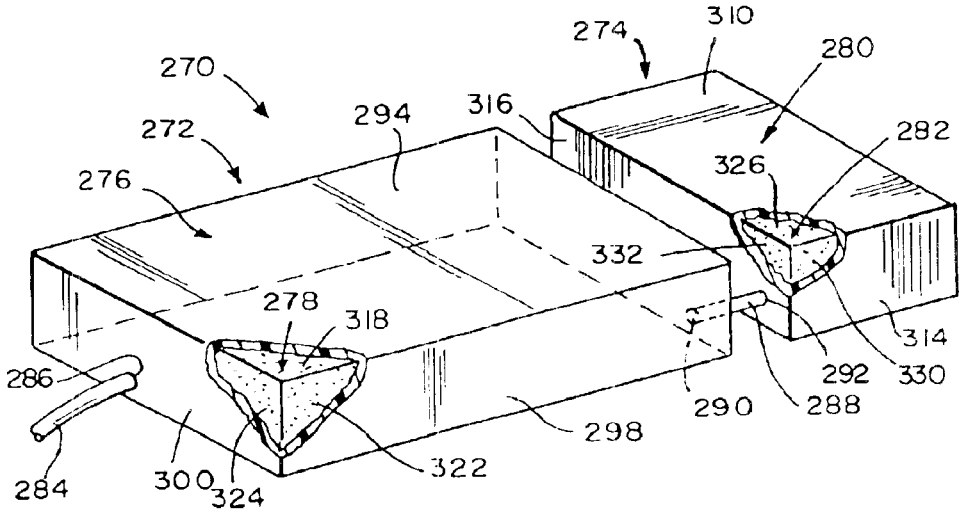
FIG. 14 is a perspective view of a fourth alternative patient-support apparatus showing a first support section, a second support section spaced apart from the first support section, a first conduit extending from one end of the first support section, a second conduit interconnecting the first and second support sections, and showing portions of covers of the first and second support sections being broken away to reveal respective foam support elements of the first and second support sections.
Figure 15:
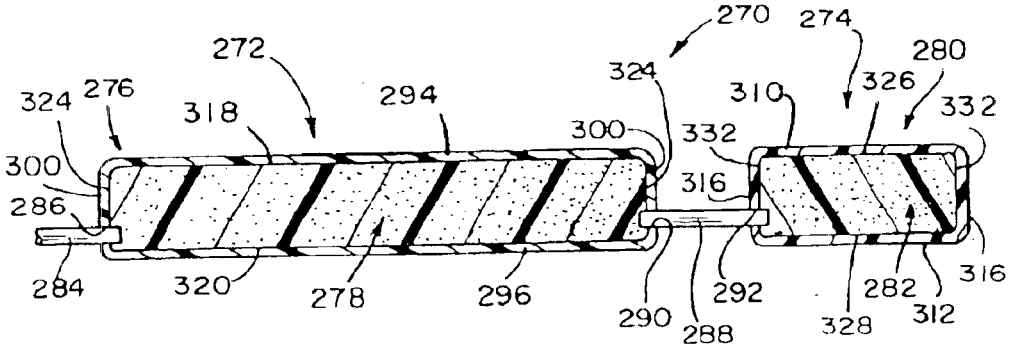
FIG. 15 is a sectional view of the patient-support apparatus of FIG. 14 after application of a controlled amount of suction to the first and second support sections showing an upper surface of the first support section being substantially coplanar with an upper surface of the second support section.

A person support apparatus 20 having a multi-piece cover 24 that encapsulates a block 22 of low ILD foam material is shown in FIGS. 1–5. A person-support apparatus 80 having a foam block 82 and a multi-piece cover 84 with stabilizing members 130 coupled to the sides and ends of cover 84 is shown in FIGS. 6–8. A person support apparatus 150 having a one-piece cover 152 and a two-piece core comprising an upper foam layer 154 and a lower foam layer 156 is shown in FIGS. 9 and 10. A person-support apparatus 180 having a multi-piece core 182 and a multi-piece cover 184 encasing core 182 is shown in FIGS. 11–13. A person-support apparatus 270 having spaced-apart first and second encased foam sections 272, 274 is shown in FIGS. 14 and 15. In some embodiments, a suction source applies suction to at least a portion of the core of the respective apparatus 20, 80, 150, 180, 270 through a pressure regulator and one or more conduits to evacuate a portion of air from the interior region of covers 24, 84, 152, 184 of apparatus 20, 80, 150, 180, respectively, and from the interior regions of covers 276, 280 of apparatus 270 thereby establishing preset negative pressure levels within the respective interior regions to partially compress some or all of the foam elements in the interior regions.

A person-support apparatus 20 includes a foam element or block 22 and a cover 24 that surrounds or encapsulates foam block 22 as shown in FIGS. 1–4. Cover 24 comprises upper and lower cover halves 26, 28 that couple together to provide a substantially airtight compartment or interior region 30 in which foam block 22 is situated. A first conduit 32, such as a flexible line or hose, is received in an opening 33 formed in cover 24 and extends from cover 24 to a pressure regulator 34 as shown diagrammatically in FIG. 1. In addition, a second conduit 36 extends from pressure regulator 34 to a suction source 38 as also shown diagrammatically in FIG. 1.

Suction source 38 operates to evacuate a portion of air from interior region 30 through conduits 32, 36 and through pressure regulator 34 so that foam block 22 is reduced in size within interior region 30. Pressure regulator 34 functions to meter or control the amount of suction applied to interior region 30 by suction source 38 so that foam block 22 is compressed only partially by the applied suction. Thus, even after the application of suction to interior region 30, foam block 22 is able to compress further by the weight of a person lying on person-support apparatus 20.

Illustrative person-support apparatus 20 is a mattress sized to support a person's entire body. However, the teachings in this disclosure are applicable to all types of cushions, pillows, support pads, etc. that support a part or all of a person's body, including surgical table mattress pads having separate sections. Therefore, the term "person-support apparatus" as used in the specification and in the claims is intended to broadly cover all types of mattresses, pillows, pads, and the like that support some or all of a person's body. In addition, foam elements having shapes other than those illustrated herein are within the scope of this disclosure.

In one embodiment, pressure regulator is configured so that a negative pressure of about 25 millimeters of Mercury (mmHg) below atmosphere is established in interior region 30. However, it is within the scope of this disclosure for other negative pressures, higher or lower than 25 mmHg below atmosphere, to be established in interior region 30. Pressure regulator 34 may be any type of device capable of regulating pressure between an inlet and an outlet of the device. Such devices are well-known to those skilled in the art. Exemplary pressure regulators are shown and described in U.S. Pat. Nos. 6,318,407; 6,178,997; 6,089,259; 6,056,008; 6,003,555; 5,899,223; 5,711,340; 5,760,301; 5,107,887; and 4,679,582; all of which are hereby incorporated by reference herein to provide general information about pressure regulators.

In some embodiments, pressure regulator 34 is configured to permit adjustment of the amount of negative pressure established in interior region between a plurality of negative pressure values. It is within the scope of this disclosure for adjustments in the negative pressure characteristics of pressure regulator 34 to be made manually by an operator, such as by turning a knob or screw, moving a lever, etc. or to be made by a more sophisticated control system having electrical circuitry that signals electromechanical devices, pneumatic devices, or any other type of suitable driver to make the adjustments. Thus, the term "pressure regulator" as used in the specification and in the claims is intended to broadly cover all types of devices that perform the function of pressure regulation unless specifically stated otherwise.

In some embodiments, suction source 38 comprises a vacuum pump, compressor, or the like that is carried in a portable housing. In such embodiments, pressure regulator 34 may also be carried in the portable housing along with suction source 38. In other embodiments, suction source 38 comprises a hand or foot pump that an operator pumps manually to evacuate air from a canister, tank, reservoir or other receptacle to establish a negative pressure in the canister, tank, etc. Hospitals and other types of healthcare facilities, such as nursing homes, outpatient surgery centers, short-term rehabilitation facilities and the like, oftentimes have medical gas systems including vacuum lines routed throughout the facility. These vacuum lines usually terminate at suction outlets which are located throughout the healthcare facility on, for example, room walls, head wall units, columns, and overhead arms. Thus, in some embodiments, suction source 38 comprises a medical gas system of a healthcare facility. Therefore, the term "suction source" as used in the specification and in the claims is intended to cover devices of all types that operate to establish negative pressure (i.e. pressure below atmospheric pressure).

Figure 1:
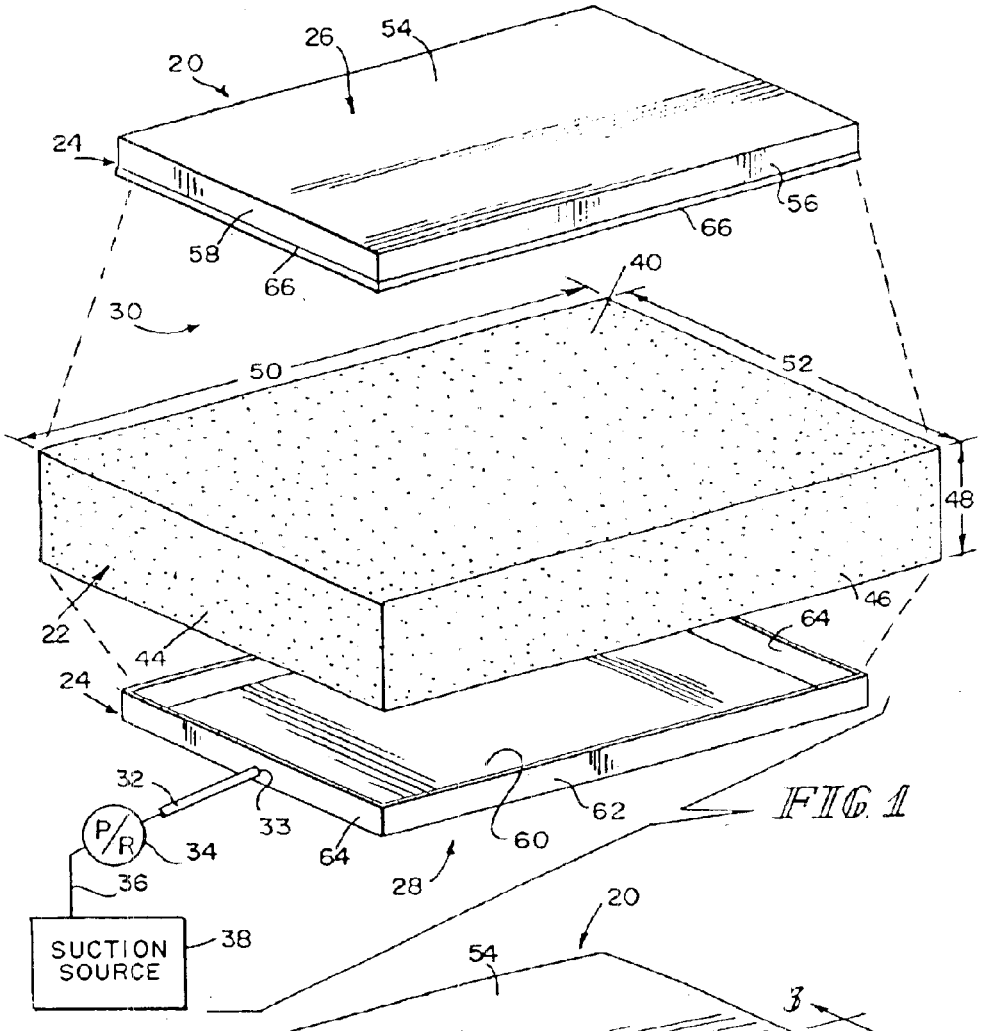
FIG. 1 is an exploded perspective view of a person-support apparatus showing a cover having an upper cover half and a lower cover half, a large block of low ILD foam situated between the upper and lower cover halves, a first conduit extending from the lower cover half to a pressure regulator, and a second conduit extending from the pressure regulator to a suction source.

Foam block 22 of person-support apparatus 20 has a horizontal top surface 40 that faces upwardly, a horizontal bottom surface 42 that faces downwardly, a pair of end surfaces 44 that extend vertically between top surface 40 and bottom surface 42, and a pair of side surfaces 46 that extend vertically between top surface 40 and bottom surface 42. When foam block 22 is in an uncompressed state as shown in FIG. 1, each of surfaces 40, 42, 44, 46 are substantially planar. In addition, when in the uncompressed state, foam block 22 has a vertical thickness 48, a horizontal length 50, and a horizontal width 52 as shown in FIG. 1. Thickness 48 of illustrative block 22 is smaller than length 50 and width 52. Thus, buckling situations which arise in columnar foam blocks that are elongated vertically are generally not present in apparatus 20.

Upper cover half 26 has a top sheet or panel 54, a pair of side sheets or panels 56 hanging downwardly from the peripheral sides of panel 54, and a pair of end sheets or panels 58 hanging downwardly from the peripheral ends of panel 54 as shown in FIG. 1. Lower cover half 28 has a bottom sheet or panel 60, a pair of side sheets or panels 62 extending upwardly from the peripheral sides of panel 60, and a pair of end sheets or panels 64 extending upwardly from the peripheral ends of panel 60. The bottom portion of panels 56, 58 of upper cover half 26 couple to the top portion of panels 62, 64, respectively, of lower cover half 28. Illustrative upper cover half 26 includes a set of flaps 66 that flare outwardly and downwardly from the lower portion of panels 56, 58 and that couple to the outer surface of panels 62, 64, respectively, along the upper portions thereof.

Several different ways of coupling cover halves 26, 28 together are contemplated by this disclosure. For example, in some embodiments zippers (not shown) are provided along the upper edge of panels 62, 64 and along the lower edge of panels 56, 58 and in other embodiments adhesive is applied to portions of panels 56, 58, 62, 64. Heat sealing or sonic welding of panels 56, 58 to panels 62, 64, respectively, is also contemplated by this disclosure, as is sewing some or all of panels 56, 58 to panels 62, 64. In addition, cover halves 26, 28 are made of a material that is substantially impermeable to air. Thus, cover 24 is airtight or substantially airtight so that when suction is applied to interior region 30, negative pressure is established therein.

According to this disclosure, a cover or casing is considered to be "substantially airtight" even if it has one or more holes or openings through which air flows from the surrounding atmosphere into interior region 30, so long as the requisite amount of negative pressure is able to be established in interior region by suction source 38 despite the existence of such holes or openings. Such holes or openings may exist, for example, between teeth of a zipper used to couple together cover halves 26, 28. In addition, in a healthcare environment, syringe needles or suture needles may inadvertently puncture cover 24 to create holes in cover 24. If holes or other openings, such as slits or punctures, are created inadvertently in the covers of the mattresses disclosed herein and are large enough that the negative pressure in the interior region of the mattress is lost or seriously degraded, the mattresses disclosed herein are still usable because the foam elements will simply bulge or otherwise expand through the large opening(s) but will still be able to support a person. This is contrary to, for example, air mattresses in which large holes or openings may result in complete or substantial deflation of the air mattress thereby rendering these types of air mattress unusable.

Figure 2:
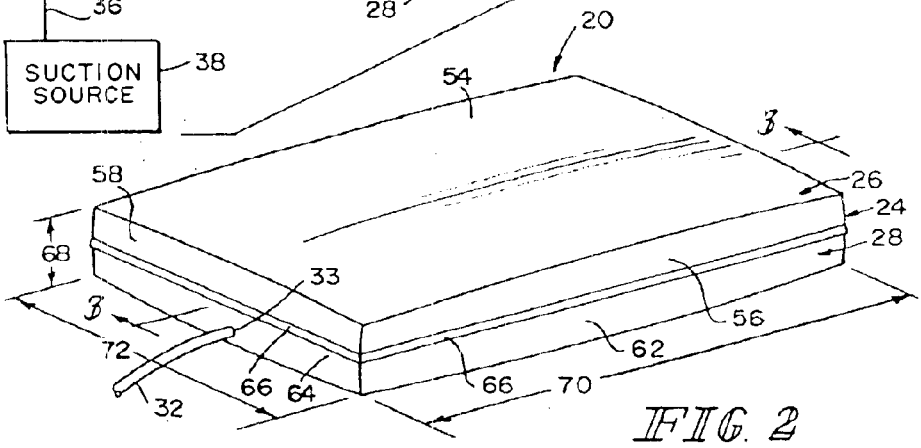
FIG. 2 is a perspective view of the person-support apparatus of FIG. 1 showing the upper and lower cover halves coupled together to encase the large block of low ILD foam and the suction source being in an off state.
Figure 3:
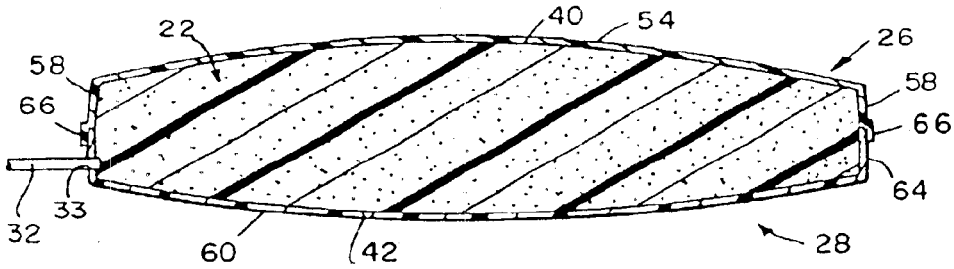
FIG. 3 is a cross sectional view of the person-support apparatus of FIG. 2, taken along line 3—3, prior to the application of a preset amount of suction to an interior region of the cover, showing the foam element bulging in a middle area due to the foam block being overstuffed in the cover.

Cover 24 has a vertical thickness 68, a horizontal length 70, and a horizontal width 72 as shown in FIG. 2. Thickness 68, length 70, and width 72 of cover 24 are smaller than thickness 48, length 50, and width 52, respectively, of foam block 22. Thus, uncompressed foam block 22 occupies a volume that is larger than the volume of interior region 30 of cover 24 as suggested in FIG. 1. Therefore, foam block 22 is overstuffed in cover 24. In other words, when upper cover half 26 is coupled to lower cover half 28 to encase foam block 22, cover 24 mechanically compresses foam block 22 by some amount. When suction is applied to interior region 30, the suction pneumatically compresses foam block 22 by an additional amount.

Application of a particular, threshold amount of suction to interior region 30 compresses foam block 22 pneumatically by an amount that reduces foam block 22 to a size that occupies a volume that is substantially equivalent to the volume of interior region 30 defined by cover 24. Application of the threshold amount of suction is depicted in FIG. 4. If less than the threshold amount of suction is applied to interior region, then cover 24 will continue to mechanically compress foam block 22 by some amount, albeit less than the amount of mechanical compression that exists prior to the application of any suction to interior region 30. If more than the threshold amount of suction is applied to interior region 30, then foam block 22 will be pneumatically compressed to a size occupying less volume than the volume of interior region 30 resulting in slack cover material around foam block 22. By adjusting pressure regulator 34, the amount of pneumatic compression of foam block 22 may be varied as desired.

Foam block 22 is made of an open-cell foam material so that when suction is applied to interior region 30, some of the air within the volume of block 22 flows out of the volume of block 22 through the various random passageways inherent in foam block 22 and out of interior region 30 through conduit 32. Assuming that apparatus 20 is lying on a stationary underlying horizontal support surface, such as that provided by an articulated support deck of a hospital bed or surgical table, then application of suction to interior region 30 draws top surface 40 of foam block 22 along with top panel 54 of cover 24 downwardly from a first position, indicated by dashed line 74 in FIG. 5, to a baseline position as shown in FIG. 5 (in solid).

Partial evacuation of air from interior region 30 by suction source 38 creates a preload condition in foam block 22. In the preload condition, the negative pressure established in interior region 30 by suction source 38, which has a tendency to compress foam block 22 as indicated by downwardly directed arrows 76 shown in FIG. 5, is counteracted by an equal and opposite pressure generated by the stresses created in the cross-linked foam material of block 22, which stresses seek to return foam block 22 back to its uncompressed state as indicated by upwardly directed arrows 78 in FIG. 5. Thus, the preload condition corresponds to an equilibrium pressure condition established in foam block 22 by suction source 38 before any external bodies, such as a person, are supported on apparatus 20.

The Indentation Load Deflection (ILD) is a well-known, industry-accepted index indicating the firmness or softness of materials such as urethane foam and other foam rubber materials. The ILD is a number that indicates the load required to compress a test block of foam material by 25%. Thus, foam materials having low ILD numbers are "softer" than foam materials having high ILD numbers. That is, foam materials having low ILD numbers are more easily compressible than foam materials having high ILD numbers. It is known that foam materials do not obey Hooke's law in the way that conventional springs do, and therefore, force-versus-displacement curves for foam materials are non-linear whereas force versus length curves for conventional springs are substantially linear. Thus, for example, a doubling in the weight of an object supported by a foam element does not necessarily result in a doubling of the interface pressure between the foam element and the object, assuming the foam element has not been completely compressed by the object to create a "bottoming" situation.

It is desirable to minimize interface pressures between a person-support apparatus and a person supported by the apparatus. Ideally, the interface pressure between a person and an underlying support surface of the apparatus is spread out uniformly over the entire area of contact between the person and the surface. It is known that highly compressible, softer foam materials having low ILD's more closely approximate the ideal situation of having uniform interface pressure than do foam materials having higher ILD's. Because low ILD foam is very compressible, a fairly large thickness of low ILD foam is needed to support the weight of a person's body to avoid bottoming. However, practical considerations, such as storing and handling, as well as space constraints on hospital beds, surgical tables, and the like, make the use of large thickness pieces of low ILD foam unappealing to many users.

According to this disclosure, foam block 22 is made of a foam material having a relatively low ILD that, when in the uncompressed state, has a fairly large thickness (i.e. thickness 48). However, by overstuffing foam block 22 in cover 24 and by applying suction to interior region 30 to pneumatically compress foam flock 22 from thickness 48 to about thickness 68, the positive attributes associated with a thick block of low ILD foam is realized in apparatus 20. Although foam block 22 is partially compressed mechanically and/or pneumatically within interior region 30 from thickness 48 to thickness 68, foam block 22 becomes further compressed by the weight of the person supported on apparatus 20. While the teachings of the present disclosure are applicable to foam elements having any ILD value, in those embodiments where interface pressures between a person and an underlying support surface are to be reduced or minimized, better results are achieved if foam block 22 is made of low ILD foam material than if foam block 22 is made of medium ILD or high ILD foam material. Foam materials having an ILD of about 25 or less are considered to be "low ILD" in accordance with this disclosure. In one embodiment, a very low ILD foam having an ILD of about 4 with an initial thickness of about twelve inches is compressed to a thickness of about three inches when an appropriate amount of suction is applied.

An alternative person-support apparatus 80 includes a foam block 82, a cover 84 that encapsulates foam block 82, and a conduit 86 that is received in an opening 83 formed in cover 84 and that extends from cover 84 to a pressure regulator (not shown). Cover 84 comprises upper and lower cover halves 86, 88 that couple together to provide a substantially airtight compartment or interior region 90 in which foam block 82 is situated. A suction source applies suction through the pressure regulator and through conduit 92 to establish negative pressure in interior region 90.

Foam block 82 of person-support apparatus 80 has a horizontal top surface 94 that faces upwardly, a horizontal bottom surface 96 that faces downwardly, a pair of end surfaces 98 that extend vertically between surfaces 94, 96, and a pair of side surfaces 100 that extend vertically between surfaces 94, 96. When foam block 82 is in an uncompressed state, as shown in FIG. 6, each of surfaces 94, 96, 98, 100 are substantially planar. In addition, when in the uncompressed state, foam block 82 has a vertical thickness 110, a horizontal length 112, and a horizontal width 114 as shown in FIG. 6.

Upper cover half 86 has a top sheet or panel 116, a pair of side sheets or panels 118 hanging downwardly from the peripheral sides of panel 116, and a pair of end sheets or panels 120 hanging downwardly from the peripheral ends of panel 116 as shown in FIG. 6. Lower cover half 88 has a bottom sheet or panel 122, a pair of side sheets or panels 124 extending upwardly from the peripheral sides of panel 122, and a pair of end sheets or panels 126 extending upwardly from the peripheral ends of panel 122. The bottom portion of panels 118, 120 of upper cover half 86 couple to the top portion of panels 124, 126, respectively, of lower cover half 88 via adhesive, sonic welding, zippers, or other suitable couplers (not shown).

Cover 84 includes a plurality of stabilizing members 128 and a plurality of sleeves 130 that couple members 128 to respective panels 118, 120, 124, 126 of cover 84. Each sleeve 130 receives a respective stabilizing member 128. Each stabilizing member 128 is elongated and extends parallel with surfaces 94, 96 of foam block 82 when foam block 82 in the uncompressed state. The stabilizing members 130 are grouped into a first set, associated with upper cover half 86, and a second set, associated with lower cover half 88. The members 130 of the first set lie in a first horizontal plane 132 and the members 130 of the second set lie in a second horizontal plane 134 that is located beneath first horizontal plane 132 as shown in FIG. 7. Cover 84 further includes a plurality of tie straps 136, some of which are coupled to upper cover half 86 and some of which are coupled to lower cover half 88. Illustrative tie straps 136 associated with upper cover half 86 extend over the corresponding sleeves 130 and members 128 from the junction between sleeves 130 and panels 118, 120. Illustrative tie straps 136 associated with lower cover half 88 extend under the corresponding sleeves 130 and members 128 from the junction between sleeves 130 and panels 124, 126.

Cover 84 is sized so that interior region 90 is substantially equivalent to the volume occupied by foam block 82 when foam block 82 is in the uncompressed state. That is, when cover 84 is in an expanded configuration, shown in FIG. 7, cover 84 encases foam block 82 without mechanically compressing foam block 82. In alternative embodiments, foam block 82 is replaced with a larger foam block that is overstuffed in interior region 90 similar to the manner in which foam block 22 of person-support apparatus 20 is overstuffed in interior region 30 as described above. When suction is applied to interior region 90 of cover 84 to evacuate a portion of air therefrom, foam block 82 reduces in volume and cover 84 becomes slack or loose around foam black 82. However, stabilizing bars 128 inhibit top panel 116 of cover 84 from wrinkling on top surface 94 of foam block 82 when cover 84 becomes slack around foam block 82. Therefore, the stabilizing bars 128 associated with upper cover half 86 serve as a framework to maintain top panel 116 generally taut when suction is applied to interior region 90.

Applying suction to interior region 90 draws top surface 96 of foam block 82, along with top panel 116 of cover 24, downwardly from a first position, indicated by dashed line 138 in FIG. 8, to a baseline position as shown in FIG. 8 (in solid). As top panel 116 is drawn downwardly, the first set of stabilizing members 128, which are coupled to upper cover half 86, move downwardly toward the second set of stabilizing members 128, which are coupled to lower cover half 88, and the portions of panels 118, 120, 124, 126 between the first set of members 128 and the second set of members 128 become folded or bunched between the first and second set of members 128. Thus, the slack created in cover 84 due to the partial evacuation of air from interior region 90 is taken up along the sides and the ends of cover 84. Associated pairs of tie straps 136 from upper and lower cover halves 86, 88 are tied together to retain the bunched portions of panels 118, 120, 124, 126 alongside vertical surfaces 98, 100 of foam block 82.

Evacuation of air from foam block 82 causes thickness 10, length 112, and width 114 of foam block 82 to be reduced. However, even though end surfaces 98 and side surfaces 100 of foam block 82 recede toward a central region of foam block 82 when suction is applied to interior region 90, the bunched portions of panels 118, 120, 124, 126 move into the space once occupied by portions of foam block 82 adjacent the receding end and side surfaces 98, 100, thereby preventing sizable gaps from forming between cover 84 when suction is applied to interior region 90.

An upper set of spacers 140 are coupled to panels 118, 120 beneath the associated sleeves 130 and a lower set of spacers 142 are coupled to panels 124, 126 above the associated sleeves 130 as shown best in FIG. 6. Spacers 140 are vertically aligned with spacers 142 and move downwardly into contact with spacers 142 when a suitable amount of suction is applied to interior region 90. Contact between spacers 140, 142 limits the amount that the upper, first set of stabilizing members 128 are drawn toward the lower, second set of stabilizing members 128 due to either evacuation of air from interior region 90 or tying tie straps 136 together. Thus, contact between spacers 140, 142 limits the amount that cover 84 is able to collapse and corresponds, generally, to the baseline position of foam block 82. If spacers 140 are still spaced slightly from spacers 142 after foam block 82 is pneumatically compressed by the suction source, then, if desired, tie straps 136 may be used to draw the first set of stabilizing members 128 further toward the second set of stabilizing members 130 until spacers 140 contact spacers 142, thereby mechanically compressing foam block 82 slightly within interior region 90. In alternative embodiments, spacers 140, 142 are omitted and sleeves 130 carrying the first set of stabilizing members 128 contact sleeves 130 carrying the second set of stabilizing members 128 when suction is applied to interior region 90.

Although illustrative apparatus 20 has a one-piece foam core (i.e. foam block 22) filling interior region 30 of cover 24 and although apparatus 80 has a one-piece foam core (i.e. foam block 82) filling interior region 90 of cover 84, it is within the scope of this disclosure to have a core comprising multiple support elements, including elements other than foam. For example, in addition to foam, cores having gel material, one or more inflatable air bladders, vacuum bead layers, and the like are within the scope of this disclosure. In addition, thermoregulation layers including layers with passages for a heated or cooled fluid, as well as layers of resistive heating material, may be included in the core, if desired. In addition, although illustrative apparatus 20 includes a two-piece cover 24 having upper and lower cover halves 26, 28 that are approximately the same size and although illustrative apparatus 80 includes a two-piece cover 84 having upper and lower cover halves 86, 88 that are approximately the same size, it is within the scope of this disclosure to provide a two-piece cover having cover pieces of different sizes. For example, a cover having a first piece comprising top, side, and end panels and a second piece comprising a flat bottom panel including an outer periphery to which bottom edges of the side and end panels couple is within the scope of this disclosure. It is also within the scope of this disclosure to provide a one-piece cover.

Referring now to FIGS. 9 and 10, an alternative patient-support apparatus 150 comprises a one-piece cover 152 and a two-piece core having an upper foam layer 154 and a lower foam layer 156. Foam layers 154, 156 are encased by cover 152 as shown in FIG. 9. The length and width of lower foam layer 156 are substantially equivalent to the length and width, respectively, of upper foam layer 154 but the thickness of upper foam layer 154 is noticeably larger than the thickness of lower foam layer 156. Upper foam layer 154 is made of a low ILD foam material whereas lower foam layer 156 is made of a medium or high ILD foam material. Thus, lower foam layer 156 is an "anti-bottoming" layer that provides the primary support to any portion of a person on apparatus 150 that bottoms through upper foam layer 154.

Cover 152 includes a horizontal top panel 158, a horizontal bottom panel 160, a pair of side panels 162 extending vertically between panels 158, 160, a first end panel 164 extending vertically between panels 158, 160, and a second end panel 166 extending vertically between panels 158, 160. Panel 166 has an elongated opening 168 bounded by a zipper 170 that opens and closes opening 168. When zipper 170 is opened, foam layers 154, 156 are inserted into the interior region of cover 152 through opening 168 such that foam layer 154 rests atop foam layer 156. Thereafter, zipper 170 is closed so that foam layers 154, 156 are retained in the interior region of cover 152. The volume occupied by foam layers 154, 156 is larger than the interior region of cover 152 and therefore, foam layers 154, 156 are overstuffed in cover 152.

A conduit 172 is received in an opening 173 and extends from cover 152 to a pressure regulator (not shown). A suction source applies suction through the pressure regulator and through conduit 172 to establish a preset negative pressure in the interior region of cover 152. The application of suction to the interior region of cover 152 evacuates a portion of the air from each of foam layers 154, 156, thereby reducing the volume occupied by foam layers 154, 156. When a threshold negative pressure is established in the interior region of cover 152, the volume occupied by foam layers 154, 156 is substantially equivalent to the volume of the interior region of cover 152 as shown in FIG. 9.

Referring now to FIG. 11, a patient-support apparatus 180 has a multi-piece core 182 and a cover or casing 184 that surrounds core 182. Core 182 comprises a bottom foam layer 186, a foam perimeter frame 188 having a large central opening 190, a foam block 192, and a cover 194 that encases foam block 192. Cover 184 includes an upper cover half 196 and a lower cover half 198. Upper cover half 196 has a horizontal top panel 200, a pair of side panels 210 extending vertically downwardly from opposite side edges of top panel 200, and a pair of end panels 212 extending vertically downwardly from opposite end edges of top panel 200. Lower cover half 198 has a horizontal bottom panel 214, a pair of side panels 216 extending vertically upwardly from opposite side edges of bottom panel 214, and a pair of end panels 218 extending vertically upwardly from opposite end edges of bottom panel 214. A set of bottom flaps 220 which flare outwardly and downwardly from panels 210, 212 couple to the top portions of panels 216, 218 such as by adhesive, sonic welding, or the like.

Bottom foam layer 186 of core 182 rests upon bottom panel 214 of lower cover half 198 and is approximately as long and as wide as bottom panel 214 of cover half 182. Thus, a minimal amount of clearance, if any, exists between vertical side surfaces 222 of bottom layer 186 and side panels 216 of cover half 198. In addition, a minimal amount of clearance, if any, exists between vertical end surfaces 224 of bottom layer 186 and end panels 218 of cover half 198. Foam perimeter frame 188 rests upon an upper surface 226 of bottom foam layer 186 and is approximately as long and as wide as bottom foam layer 186. Thus, exterior side surfaces 228 of foam frame 188 are coplanar with side surfaces 222 of layer 186 and exterior end surfaces 230 of foam frame 188 are coplanar with end surfaces 224 of layer 186. In addition, a minimal amount of clearance, if any, exists between surfaces 228, 230 of foam frame 188 and panels 216, 218, respectively, of lower cover half 182. Foam frame 188 has a larger vertical thickness than layer 186 as shown in FIGS. 11–13.

Foam block 192 has a horizontal top surface 248, a horizontal bottom surface 250, a pair of vertical side surfaces 252 extending between surfaces 248, 250, and a pair of vertical end surfaces 254 extending between surfaces 248, 250. Cover 194 that encases foam block 192 has a horizontal top panel 232, a horizontal bottom panel 234, a pair of side panels 236 extending vertically between side edges of panels 232, 234, and a pair of end panels extending vertically between end edges of panels 232, 234. The volume of the interior region of cover 194 is approximately the same as the volume of foam block 192 when foam block 192 is in an uncompressed state as shown in FIG. 11.

Foam frame 188 has interior side surfaces 240 and interior end surfaces 242 that extend vertically between an upper surface 244 of foam frame 188 and a lower surface 246 of foam frame 188 to define central opening 190 in frame 188. Foam block 192 and cover 194 are received in opening 190 of foam frame 188 such that bottom panel 234 of cover 194 is sandwiched between upper surface 226 of foam layer 186 and bottom surface 250 of foam block 192, such that the lower portion of side panels 236 of cover 194 are sandwiched between respective interior side surfaces 240 of foam frame 188 and respective side surfaces 252 of foam block 192, and such that the lower portion of end panels 238 of cover 194 are sandwiched between respective interior end surfaces 242 of foam frame 188 and respective end surfaces 254 of foam block 192. Thus, panel 234 of cover 194 rests upon upper surface 226 of bottom layer 186 such that bottom surface 250 of foam block 192 is substantially coplanar with bottom surface 246 of foam frame 188 as shown in FIGS. 12 and 13.

When foam block 192 is in an uncompressed state, side surfaces 252 of foam block 192 are spaced apart further than are interior side surfaces 240 of foam frame 188 and end surfaces 254 of foam block 192 are spaced apart further than are interior end surfaces 242 of foam frame 188. Thus, the lower portion of foam block 192 is overstuffed in foam frame 188 prior to application of suction to the interior region of cover 194 as shown best in FIG. 12. In the uncompressed state, foam block 192 is thicker than foam frame 188 and therefore, upper surface 248 of foam block 192 is higher in elevation than upper surface 244 of foam frame 188 prior to the application of suction to the interior region of cover 194 as also shown in FIG. 12.

Apparatus 180 includes a conduit 256 that is received in an opening 258 formed in cover 194 and that extends from cover 194 to a pressure regulator (not shown) which is, in turn, coupled to a suction source (not shown). Bottom surface 246 of foam frame 188 is formed to include a notch 260 which extends from one of interior end surfaces 242 to one of exterior end surfaces 230. One of end panels 218 of lower cover half 198 has an aperture 262 that is horizontally aligned with notch 260. Conduit 256 extends from cover 194 through notch 260 and through aperture 262. Thus, a portion of conduit 256 is sandwiched between foam frame 188 and bottom foam layer 186.

Application of suction to the interior region of cover 194 evacuates a portion of air from foam block 192 and pneumatically compresses foam block 192 from the configuration shown in FIG. 12 to the configuration shown, for example, in FIG. 13. If a threshold negative pressure level is established in the interior region of cover 194, then foam block 192 is reduced to a volume having upper surface 248 of foam block 192 substantially coplanar with upper surface 244 of foam frame 188 as shown in FIG. 13. Negative pressures above or below the threshold pressure level are within the scope of this disclosure.

In the illustrated embodiment, cover 194 becomes slack or loose around foam block 192 and cover 184 becomes slack or loose around core 182 after suction is applied to the interior region of cover 194. Because covers 184, 194 are loose after foam block 192 is pneumatically compressed, top panels 200, 232 of respective covers 184, 194 have a tendency to move with a person's skin, rather than against the person's skin, as the person moves on apparatus 180.

In the illustrative embodiment, foam block 192 is made of a foam material having a low ILD, whereas bottom foam layer 186 and foam frame 188 are made from foam materials having either medium or high ILD's. By having foam frame 188 made of a material that is firmer than the material from which foam block 192 is made, a person sitting on apparatus 180 near the sides or ends thereof, such as occurs when getting onto or off of apparatus 180, will not sink down into apparatus 180 as much as if foam frame 188 were also made of low ILD foam. Furthermore, bottom foam layer 186 of apparatus 180 performs an anti-bottoming function.

Referring now to FIGS. 14 and 15, a patient-support apparatus 270 has a first support section 272 and a second support section 274 spaced apart from first support section 272. Section 272 has a cover or casing 276 and a foam block 278 in the interior region of cover 276. Similarly, section 274 has a cover or casing 280 and a foam block 282 in the interior region of cover 280. A first conduit 284 extends from an opening 286 formed in cover 276 to a pressure regulator (not shown) which, in turn, is coupled to a suction source (not shown). A second conduit 288 pneumatically couples the interior region of cover 276 of section 272 to the interior region of cover 280 of section 274. Thus, one end of conduit 288 is received in an opening 290 formed in cover 276 and the other end of conduit 288 is received in an opening 292 formed in cover 280.

Cover 276 includes a horizontal top panel 294, a horizontal bottom panel 296, a pair of vertical side panels 298, and a pair of vertical end panels 300. Similarly, cover 280 includes a horizontal top panel 310, a horizontal bottom panel 312, a pair of vertical side panels 314, and a pair of vertical end panels 316. Foam block 278 includes a horizontal top surface 318, a horizontal bottom surface 320, a pair of vertical side surfaces 322, and a pair of vertical end surfaces 324. Similarly, foam block 282 includes a horizontal top surface 326, a horizontal bottom surface 328, a pair of vertical side surfaces 330, and a pair of vertical end surfaces 332.

Application of suction to the interior region of cover 276 through conduit 284 establishes a preset negative pressure in cover 276 and evacuates a portion of air from foam block 278 to pneumatically compress foam block 278. In addition, the preset negative pressure established in the interior region of cover 276 is communicated to the interior region of cover 280 through conduit 288. Thus, a portion of the air from foam block 282 of second support section 274 is also evacuated to pneumatically compress foam block 282 when suction is applied through conduit 284 to the interior region of cover 276 of first support section 272. In alternative embodiments, one or both of sections 272, 274 have cores comprising multiple pieces of foam.

When foam blocks 278, 282 are in their respective uncompressed states, the horizontal width and vertical thickness of foam block 278 is substantially equivalent to the horizontal width and vertical thickness, respectively, of foam block 282. However, the horizontal length of foam block 278 is larger than the horizontal length of foam block 282. Therefore, illustrative apparatus 270 is configured for use on a surgical table such that first support section 272 supports the head, torso, and seat of a patient and the second support section 274 supports the legs of the patient. Conduit 288 is flexible to accommodate articulation of section 274 relative to section 272. Assuming sections 272, 274 are resting upon an underlying horizontal surface (not shown), after suction is applied to apparatus 270, upper surface 318 of foam block 278 of section 272 is substantially coplanar with upper surface 326 of foam block 282 of section 274 as shown best in FIG. 15.

With regard to each of the above-described embodiments, the interface between conduits 32, 92, 172, 256, 284 and covers 24, 84, 152, 184, 276, respectively, and the interface between conduit 288 and covers 276, 280 is airtight or substantially airtight. Sonic welding, heat sealing, or adhesive may be used to create such an airtight interface between the conduits and the associated covers. Alternatively, mechanical couplings (not shown) may be used to connect the conduits to the covers in an airtight or substantially airtight manner. Such mechanical couplings are well known to those skilled in the art and include, for example, threaded couplers, barbed couplers, and quick-connect couplers, each of which may optionally include a check valve that operates to close the associated opening upon disconnection of the conduit from the associated cover. In some embodiments, such mechanical couplings are also provided for connecting conduits, such as conduit 36 of apparatus 20, to the associated pressure regulator or suction source. See, for example, U.S. Pat. Nos. 6,212,718; 5,845,943; 5,647,079; 5,487,196; 5,033,777; and 4,436,125; each of which shows examples of mechanical couplers used in pneumatic systems and each of which is hereby incorporated by reference herein.

It is within the scope of this disclosure to have additional layers of materials (not shown), such as fire barrier material or anti-shear material, between the respective covers and cores of each apparatus 20, 80, 150, 180, 270 and between the various elements of multi-piece cores. Anti-shear materials include, for example, NYLON® sheets, polyethylene sheets, and the like, that facilitate movement between portions of a person-support apparatus by reducing friction between the moving elements. It is also within the scope of this disclosure for each apparatus 20, 80, 150, 180, 270 to have one or more manifolds, screens, flow channels, perforated tubes, conduits, or the like situated within the associated interior regions of apparatus 20, 80, 150, 180, 270 and coupled pneumatically to the associated conduits to distribute suction more evenly or uniformly throughout the associated interior regions.

Although certain illustrative embodiments have been described in detail above, variations and modifications exist within the scope and spirit of this disclosure as described and as defined in the following claims.

What is claimed is:

1. A person-support apparatus for use with a suction source, the person-support apparatus comprising a core having a first foam element, the first foam element having a vertical thickness, a horizontal length, and a horizontal width, the vertical thickness being smaller than both the horizontal length and the horizontal width when the first foam element is in an uncompressed state, a cover having an interior region in which the core is situated, the first foam element filling at least a majority of the interior region, the cover having an opening in fluid communication with the suction source, the suction source operating to evacuate a portion of air from the interior region so that the first foam element is partially compressed within the interior region of the cover due to the evacuation of the portion of air, the interior region of the cover having a first volume and the first foam element, when in the uncompressed state, occupying a second volume that is larger than the first volume, and a pressure regulator spaced from the cover, the pressure regulator being in fluid communication with the suction source and with the interior region.

2. The person-support apparatus of claim 1, wherein the pressure regulator operates to establish a preset negative pressure in the interior region when suction is applied by the suction source to the pressure regulator.

3. The person-support apparatus of claim 1, further comprising a second foam element outside the interior region and underlying the first foam element, the first foam element having a first indentation load deflection (ILD) value, and the second foam element having a second ILD value that is higher than the first ILD value.

4. The person-support apparatus of claim 3, wherein the second foam element has a vertical thickness that is smaller than the vertical thickness of the first foam element.

5. The person-support apparatus of claim 4, wherein the second foam element has a horizontal length that is longer than the horizontal length of the first foam element and the second foam element has a horizontal width that is wider than the horizontal width of the first foam element.

6. The person-support apparatus of claim 3, further comprising a foam frame having an opening in which at least a portion of the first foam element is situated.

7. The person-support apparatus of claim 6, wherein the first foam element has a first top surface, the foam frame has a second top surface, the first top surface is higher in elevation than the second top surface when the first foam element is in an uncompressed state, and the first top surface is substantially coplanar with the second top surface when a predetermined amount of suction is applied to the interior region by the suction source.

8. The person-support apparatus of claim 6, further comprising an outer casing encapsulating the core, the cover, the second foam element, and the foam frame.

9. The person-support apparatus of claim 1, further comprising a foam frame having an opening in which at least a portion of the first foam element is situated.

10. The person-support apparatus of claim 9, wherein the first foam element has a first top surface, the foam frame has a second top surface, the first top surface is higher in elevation than the second top surface when the first foam element is in an uncompressed state, and the first top surface is substantially coplanar with the second top surface when a predetermined amount of suction is applied to the interior region by the suction source.

11. The person-support apparatus of claim 10, wherein the foam frame is situated outside the interior region.

12. The person-support apparatus of claim 10, further comprising an outer casing encapsulating the core, the cover, and the foam frame.

13. A person-support apparatus for use with a suction source, the person-support apparatus comprising a core having a first foam element, the first foam element having a vertical thickness, a horizontal length, and a horizontal width, the vertical thickness being smaller than both the horizontal length and the horizontal width when the first foam element is in an uncompressed state, a cover having an interior region in which the core is situated, the first foam element filling at least a majority of the interior region, the cover having an opening in fluid communication with the suction source, the suction source operating to evacuate a portion of air from the interior region so that the first foam element is partially compressed within the interior region of the cover due to the evacuation of the portion of air, the interior region of the cover having a first volume and the first foam element, when in the uncompressed state, occupying a second volume that is larger than the first volume, and a pressure regulator in fluid communication with the suction source and with the interior region, the pressure regulator operating to establish a preset negative pressure in the interior region when suction is applied by the suction source, the pressure regulator being configured to permit adjustment of the preset negative pressure between at least first and second pressure values.

14. A person-support apparatus for use with a suction source, the person-support apparatus comprising a core having a first foam element, the first foam element having a vertical thickness, a horizontal length, and a horizontal width, the vertical thickness being smaller than both the horizontal length and the horizontal width when the first foam element is in an uncompressed state, a cover having an interior region in which the core is situated, the first foam element filling at least a majority of the interior region, the cover having an opening in fluid communication with the suction source, the suction source operating to evacuate a portion of air from the interior region so that the first foam element is partially compressed within the interior region of the cover due to the evacuation of the portion of air, the interior region of the cover having a first volume and the first foam element, when in the uncompressed state, occupying a second volume that is larger than the first volume, a pressure regulator in fluid communication with the suction source and with the interior region, the pressure regulator operating to establish a preset negative pressure in the interior region when suction is applied by the suction source, and a first conduit fluidly coupling the interior region to the pressure regulator and a second conduit fluidly coupling the pressure regulator to the suction source.

15. A person-support apparatus for use with a suction source, the person-support apparatus comprising a core having a first foam element, the first foam element having a vertical thickness, a horizontal length, and a horizontal width, the vertical thickness being smaller than both the horizontal length and the horizontal width when the first foam element is in an uncompressed state, a cover having an interior region in which the core is situated, the first foam element filling at least a majority of the interior region, the cover having an opening in fluid communication with the suction source, the suction source operating to evacuate a portion of air from the interior region so that the first foam element is partially compressed within the interior region of the cover due to the evacuation of the portion of air, a pressure regulator in fluid communication with the suction source and with the interior region, the pressure regulator operating to establish a preset negative pressure in the interior region when suction is applied by the suction source, a first conduit fluidly coupling the interior region to the pressure regulator, and a second conduit fluidly coupling the pressure regulator to the suction source, wherein the second conduit comprises a hose and a quick-connect coupler mounted to the hose, the quick-connect coupler being attachable to and detachable from the suction source, the quick-connect coupler automatically opening when coupled to the suction source to permit application of suction to the interior region, and the quick-connect coupler automatically closing when decoupled from the suction source to prevent ambient air from flowing toward the interior region through the quick-connect coupler.

16. A person-support apparatus for use with a suction source, the person-support apparatus comprising a core having a first foam element, the first foam element having a vertical thickness, a horizontal length, and a horizontal width, the vertical thickness being smaller than both the horizontal length and the horizontal width when the first foam element is in an uncompressed state, and a cover having an interior region in which the core is situated, the first foam element filling at least a majority of the interior region, the cover having an opening in fluid communication with the suction source, the suction source operating to evacuate a portion of air from the interior region so that the first foam element is partially compressed within the interior region of the cover due to the evacuation of the portion of air, the interior region of the cover having a first volume and the first foam element, when in the uncompressed state, occupying a second volume that is larger than the first volume, wherein the core includes a second foam element underlying the first foam element, the first foam element is characterized by a first indentation load deflection (ILD) value, and the second foam element is characterized by a second ILD value that is higher than the first ILD value.

17. The person-support apparatus of claim 16, wherein the second foam element has a vertical thickness that is smaller than the vertical thickness of the first foam element.

18. The person-support apparatus of claim 17, wherein the second foam element has a horizontal length that is substantially equivalent to the horizontal length of the first foam element and the second foam element has a horizontal width that is substantially equivalent to the horizontal width of the first foam element.

19. A person-support apparatus for use with a suction source, the person-support apparatus comprising a core having a first foam element, the first foam element having a vertical thickness, a horizontal length, and a horizontal width, the vertical thickness being smaller than both the horizontal length and the horizontal width when the first foam element is in an uncompressed state, a cover having an interior region in which the core is situated, the first foam element filling at least a majority of the interior region, the cover having an opening in fluid communication with the suction source, the suction source operating to evacuate a portion of air from the interior region so that the first foam element is partially compressed within the interior region of the cover due to the evacuation of the portion of air, and a second foam element outside the interior region and underlying the first foam element, the first foam element having a first indentation load deflection (ILD) value, and the second foam element having a second ILD value that is higher than the first ILD value, a foam frame having an opening in which at least a portion of the first foam element is situated, and a conduit coupled to the cover in fluid communication with the interior region through the opening and a portion of the conduit being situated between the foam frame and the second foam element.

20. A person-support apparatus for use with a suction source, the person-support apparatus comprising a core having a first foam element, the first foam element having a vertical thickness, a horizontal length, and a horizontal width, the vertical thickness being smaller than both the horizontal length and the horizontal width when the first foam element is in an uncompressed state, a cover having an interior region in which the core is situated, the first foam element filling at least a majority of the interior region, the cover having an opening in fluid communication with the suction source, the suction source operating to evacuate a portion of air from the interior region so that the first foam element is partially compressed within the interior region of the cover due to the evacuation of the portion of air, the cover having a pair of longitudinally spaced-apart ends, the cover having a pair of transversely spaced-apart sides, and a plurality of stabilizing members coupled to the sides and the ends of the cover.

21. The person-support apparatus of claim 20, wherein each stabilizing member is elongated and is arranged to extend substantially horizontally.

22. The person-support apparatus of claim 20, wherein the plurality of stabilizing members are grouped into a first set arranged to lie in a first horizontal plane and a second set arranged to lie in a second horizontal plane beneath the first horizontal plane.

23. The person-support apparatus of claim 22, wherein the first set of stabilizing members moves closer to the second set of stabilizing members when the portion of air is evacuated from the interior region.

24. The person-support apparatus of claim 22, further comprising a first set of spacers beneath the first set of stabilizing members and a second set of spacers above the second set of stabilizing members, the first set of spacers contacting the second set of spacers when the portion of air is evacuated from the interior region.

25. The person-support apparatus of claim 22, further comprising a plurality of flexible tie members and tying associated pairs of the plurality of flexible tie members together retains portions of the sides and the ends of the cover adjacent the core when the portion of air is evacuated from the interior region.

26. A person-support apparatus for use with a suction source, the person-support apparatus comprising a core having a first foam element, a cover having an interior region in which the core is situated, the interior region of the cover having a first volume and the first foam element, when in an uncompressed state, occupying a second volume that is larger than the first volume, a first conduit coupled to the cover, the first conduit being in fluid communication with the interior region, and a pressure regulator spaced from the cover, the pressure regulator being coupled to the conduit and coupled to the suction source, the suction source operating through the pressure regulator to evacuate a portion of air from the interior region so that the at least one foam element is partially compressed within the interior region due to the evacuation of the portion of air, the pressure regulator being configured to establish a preset negative pressure in the interior region.

27. A person-support apparatus for use with a suction source, the person-support apparatus comprising a core having a first foam element, a cover having an interior region in which the first foam element of the core is situated, the interior region of the cover having a first volume and the first foam element, when in an uncompressed state, occupying a second volume that is larger than the first volume, a first conduit coupled to the cover, the first conduit being in fluid communication with the interior region, and a pressure regulator coupled to the conduit and coupled to the suction source, the suction source operating through the pressure regulator to evacuate a portion of air from the interior region so that the at least one foam element is partially compressed within the interior region due to the evacuation of the portion of air, the pressure regulator being configured to establish a preset negative pressure in the interior region, the pressure regulator being configured to permit adjustment of the preset negative pressure between at least first and second pressure values.

28. The person-support apparatus of claim 27, further comprising a second conduit fluidly coupling the pressure regulator to the suction source.

29. A person-support apparatus for use with a suction source, the person-support apparatus comprising a core having a first foam element, a cover having an interior region in which the core is situated, a first conduit coupled to the cover, the first conduit being in fluid communication with the interior region, a pressure regulator coupled to the conduit and coupled to the suction source, the suction source operating through the pressure regulator to evacuate a portion of air from the interior region so that the at least one foam element is partially compressed within the interior region due to the evacuation of the portion of air, the pressure regulator being configured to establish a preset negative pressure in the interior region, wherein the pressure regulator is configured to permit adjustment of the preset negative pressure between at least first and second pressure values, and a second conduit fluidly coupling the pressure regulator to the suction source, wherein the second conduit comprises a hose and a quick-connect coupler mounted to the hose, the quick-connect coupler being attachable to and detachable from the suction source, the quick-connect coupler automatically opening when coupled to the suction source to permit application of suction to the interior region, and the quick-connect coupler automatically closing when decoupled from the suction source to prevent ambient air from flowing toward the interior region through the quick-connect coupler.

30. A person-support apparatus for use with a suction source, the person-support apparatus comprising a core having a first foam element, a cover having an interior region in which the core is situated, a first conduit coupled to the cover, the first conduit being in fluid communication with the interior region, and a pressure regulator coupled to the conduit and coupled to the suction source, the suction source operating through the pressure regulator to evacuate a portion of air from the interior region so that the at least one foam element is partially compressed within the interior region due to the evacuation of the portion of air, the pressure regulator being configured to establish a preset negative pressure in the interior region, wherein the core includes a second foam element underlying the first foam element, the first foam element is characterized by a first indentation load deflection (ILD) value, and the second foam element is characterized by a second ILD value that is higher than the first ILD value.

31. The person-support apparatus of claim 30, wherein the second foam element has a vertical thickness that is smaller than the vertical thickness of the first foam element.

32. The person-support apparatus of claim 31, wherein the second foam element has a horizontal length that is substantially equivalent to a horizontal length of the first foam element and the second foam element has a horizontal width that is substantially equivalent to a horizontal width of the first foam element.

33. A person-support apparatus for use with a suction source, the person-support apparatus comprising a core having a first foam element, a cover having an interior region in which the core is situated, a first conduit coupled to the cover, the first conduit being in fluid communication with the interior region, a pressure regulator spaced from the cover, the pressure regulator being coupled to the conduit and coupled to the suction source, the suction source operating through the pressure regulator to evacuate a portion of air from the interior region so that the at least one foam element is partially compressed within the interior region due to the evacuation of the portion of air, the pressure regulator being configured to establish a preset negative pressure in the interior region, and a second foam element outside the interior region and underlying the first foam element, the first foam element having a first indentation load deflection (ILD) value, and the second foam element having a second ILD value that is higher than the first ILD value.

34. The person-support apparatus of claim 33, wherein the second foam element has a vertical thickness that is smaller than a vertical thickness of the first foam element.

35. The person-support apparatus of claim 34, wherein the second foam element has a horizontal length that is longer than a horizontal length of the first foam element and the second foam element has a horizontal width that is wider than a horizontal width of the first foam element.

36. The person-support apparatus of claim 33, further comprising a foam frame having an opening in which at least a portion of the first foam element is situated.

37. The person-support apparatus of claim 36, wherein the first foam element has a first top surface, the foam frame has a second top surface, the first top surface is higher in elevation than the second top surface when the first foam element is in an uncompressed state, and the first top surface is substantially coplanar with the second top surface when a predetermined amount of suction is applied to the interior region by the suction source.

38. The person-support apparatus of claim 36, further comprising an outer casing encapsulating the core, the cover, the second foam element, and the foam frame.

39. A person-support apparatus for use with a suction source, the person-support apparatus comprising a core having a first foam element, a cover having an interior region in which the core is situated, a first conduit coupled to the cover, the first conduit being in fluid communication with the interior region, a pressure regulator coupled to the conduit and coupled to the suction source, the suction source operating through the pressure regulator to evacuate a portion of air from the interior region so that the at least one foam element is partially compressed within the interior region due to the evacuation of the portion of air, the pressure regulator being configured to establish a preset negative pressure in the interior region, a second foam element outside the interior region and underlying the first foam element, the first foam element having a first indentation load deflection (ILD) value, and the second foam element having a second ILD value that is higher than the first ILD value, and a foam frame having an opening in which at least a portion of the first foam element is situated, the first conduit has a portion situated between the foam frame and the second foam element.

40. A person-support apparatus for use with a suction source, the person-support apparatus comprising a core having a first foam element, a cover having an interior region in which the core is situated, a first conduit coupled to the cover, the first conduit being in fluid communication with the interior region, a pressure regulator spaced from the cover, the pressure regulator being coupled to the conduit and coupled to the suction source, the suction source operating through the pressure regulator to evacuate a portion of air from the interior region so that the at least one foam element is partially compressed within the interior region due to the evacuation of the portion of air, the pressure regulator being configured to establish a preset negative pressure in the interior region, and a foam frame having an opening in which at least a portion the first foam element is situated.

41. The person-support apparatus of claim 40, wherein the first foam element has a first top surface, the foam frame has a second top surface, the first top surface is higher in elevation than the second top surface when the first foam element is in an uncompressed state, and the first top surface is substantially coplanar with the second top surface when a predetermined amount of suction is applied to the interior region by the suction source.

42. The person-support apparatus of claim 41, wherein the foam frame is situated outside the interior region.

43. The person-support apparatus of claim 41, further comprising an outer casing encapsulating the core, the cover, and the foam frame.

44. A person-support apparatus for use with a suction source, the person-support apparatus comprising a core having a first foam element, a cover having an interior region in which the core is situated, a first conduit coupled to the cover, the first conduit being in fluid communication with the interior region, and a pressure regulator coupled to the conduit and coupled to the suction source, the suction source operating through the pressure regulator to evacuate a portion of air from the interior region so that the at least one foam element is partially compressed within the interior region due to the evacuation of the portion of air, the pressure regulator being configured to establish a preset negative pressure in the interior region, wherein the cover has a pair of longitudinally spaced-apart ends, the cover has a pair of transversely spaced-apart sides, and further comprising a plurality of stabilizing members coupled to the sides and the ends of the cover.

45. The person-support apparatus of claim 44, wherein each stabilizing member is elongated and is arranged to extend substantially horizontally.

46. The person-support apparatus of claim 44, wherein the plurality of stabilizing members are grouped into a first set arranged to lie in a first horizontal plane and a second set arranged to lie in a second horizontal plane beneath the first horizontal plane.

47. The person-support apparatus of claim 46, wherein the first set of stabilizing members moves closer to the second set of stabilizing members when the portion of air is evacuated from the interior region.

48. The person-support apparatus of claim 46, further comprising a first set of spacers beneath the first set of stabilizing members and a second set of spacers above the second set of stabilizing members, the first set of spacers contacting the second set of spacers when the portion of air is evacuated from the interior region.

49. The person-support apparatus of claim 46, further comprising a plurality of flexible tie members and tying associated pairs of the plurality of flexible tie members together retains portions of the sides and the ends of the cover adjacent the core when the portion of air is evacuated from the interior region.

50. A person-support apparatus for supporting a patient in a hospital room having an outlet that is coupled to a suction source, the person-support apparatus comprising a core having a first foam element, a cover having an interior region in which the core is situated, a first conduit coupled to the cover, the first conduit being in fluid communication with the interior region, a pressure regulator coupled to the first conduit, and a second conduit coupled to the pressure regulator and adapted to couple to the outlet in the hospital room, wherein when the second conduit is coupled to the outlet, a negative pressure having a magnitude established by the pressure regulator is created in the interior region of the cover to evacuate a portion of air from the interior region to partially compress the foam in the interior region.

51. The person-support apparatus of claim 50, wherein the pressure regulator is configured to permit adjustment of the magnitude of the negative pressure between at least first and second pressure values.

52. The person-support apparatus of claim 50, wherein the second conduit comprises a hose and a quick-connect coupler mounted to the hose, the quick-connect coupler being attachable to and detachable from the outlet, the quick-connect coupler automatically opening when coupled to the outlet to permit application of suction to the interior region, and the quick-connect coupler automatically closing when decoupled from the outlet to prevent ambient air from flowing toward the interior region through the quick-connect coupler.

53. The person-support apparatus of claim 50, wherein the core includes a second foam element underlying the first foam element, the first foam element is characterized by a first indentation load deflection (ILD) value, and the second foam element is characterized by a second ILD value that is higher than the first ILD value.

54. The person-support apparatus of claim 53, wherein the first foam element has a first vertical thickness, the second foam element has a second vertical thickness, and the second vertical thickness is smaller than the first vertical thickness.

55. The person-support apparatus of claim 54, wherein the first foam element has a first horizontal length and a first horizontal width, the second foam element has a second horizontal length that is substantially equivalent to the first horizontal length, and the second foam element has a second horizontal width that is substantially equivalent to the first horizontal width.

56. The person-support apparatus of claim 50, further comprising a second foam element outside the interior region and underlying the first foam element, the first foam element having a first indentation load deflection (ILD) value, and the second foam element having a second ILD value that is higher than the first ILD value.

57. The person-support apparatus of claim 56, wherein the first foam element has a first vertical thickness, the second foam element has a second vertical thickness, and the second vertical thickness is smaller than the first vertical thickness.

58. The person-support apparatus of claim 57, wherein the first foam element has a first horizontal length and a first horizontal width, the second foam element has a second horizontal length that is longer than the first horizontal length, and the second foam element has a second horizontal width that is wider than the first horizontal width.

59. The person-support apparatus of claim 56, further comprising a foam frame having an opening in which at least a portion of the first foam element is situated.

60. The person-support apparatus of claim 59, wherein the first foam element has a first top surface, the foam frame has a second top surface, the first top surface is higher in elevation than the second top surface when the first foam element is in an uncompressed state, and the first top surface is substantially coplanar with the second top surface when a predetermined amount of suction is applied to the interior region.

61. The person-support apparatus of claim 59, wherein the first conduit has a portion situated between the foam frame and the second foam element.

62. The person-support apparatus of claim 59, further comprising an outer casing encapsulating the core, the cover, the second foam element, and the foam frame.

63. The person-support apparatus of claim 50, further comprising a foam frame having an opening in which at least a portion of the first foam element is situated.

64. The person-support apparatus of claim 63, wherein the first foam element has a first top surface, the foam frame has a second top surface, the first top surface is higher in elevation than the second top surface when the first foam element is in an uncompressed state, and the first top surface is substantially coplanar with the second top surface when a predetermined amount of suction is applied to the interior region.

65. The person-support apparatus of claim 64, wherein the foam frame is situated outside the interior region.

66. The person-support apparatus of claim 64, further comprising an outer casing encapsulating the core, the cover, and the foam frame.

67. The person-support apparatus of claim 50, wherein the cover has a pair of longitudinally spaced-apart ends, the cover has a pair of transversely spaced-apart sides, and further comprising a plurality of stabilizing members coupled to the sides and the ends of the cover.

68. The person-support apparatus of claim 67, wherein each stabilizing member is elongated and is arranged to extend substantially horizontally.

69. The person-support apparatus of claim 67, wherein the plurality of stabilizing members are grouped into a first set arranged to lie in a first horizontal plane and a second set arranged to lie in a second horizontal plane beneath the first horizontal plane.

70. The person-support apparatus of claim 69, wherein the first set of stabilizing members moves closer to the second set of stabilizing members when the portion of air is evacuated from the interior region.

71. The person-support apparatus of claim 69, further comprising a first set of spacers beneath the first set of stabilizing members and a second set of spacers above the second set of stabilizing members, the first set of spacers contacting the second set of spacers when the portion of air is evacuated from the interior region.

72. The person-support apparatus of claim 69, further comprising a plurality of flexible tie members and tying associated pairs of the plurality of flexible tie members together retains portions of the sides and the ends of the cover adjacent the core when the portion of air is evacuated from the interior region.

* * * * *